US009334885B2

(12) United States Patent
Okihara et al.

(10) Patent No.: US 9,334,885 B2
(45) Date of Patent: May 10, 2016

(54) PUMP SUCTION PIPE

(71) Applicant: Hitachi, Ltd., Chiyoda-ku, Tokyo (JP)

(72) Inventors: Takashi Okihara, Tsuchiura (JP); Takahide Nagahara, Abiko (JP); Daichi Torii, Tsukuba (JP); Takeshi Kazama, Tsuchiura (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 13/860,555

(22) Filed: Apr. 11, 2013

(65) Prior Publication Data

US 2013/0269817 A1 Oct. 17, 2013

(30) Foreign Application Priority Data

Apr. 12, 2012 (JP) ..... 2012-090626

(51) Int. Cl.

| | |
|---|---|
| ***F15D 1/00*** | (2006.01) |
| ***F15D 1/04*** | (2006.01) |
| ***E03B 5/00*** | (2006.01) |
| ***F04B 39/00*** | (2006.01) |
| ***F04B 53/16*** | (2006.01) |
| ***F04D 29/42*** | (2006.01) |
| ***F04D 29/68*** | (2006.01) |

(52) U.S. Cl.

CPC . *F15D 1/001* (2013.01); *E03B 5/00* (2013.01); *F04B 39/00* (2013.01); *F04B 53/16* (2013.01); *F04D 29/4273* (2013.01); *F04D 29/688* (2013.01); *F15D 1/04* (2013.01)

(58) Field of Classification Search

USPC ..... 138/39; 285/179, 181

See application file for complete search history.

(56) References Cited

U.S. PATENT DOCUMENTS 210,367 A * 11/1878 Stern et al. ..... 285/181
244,720 A * 7/1881 Hilderbrandt ..... 285/181

(Continued)

FOREIGN PATENT DOCUMENTS

CN 101830278 A 9/2010
EP 1318344 A1 6/2003

(Continued)

OTHER PUBLICATIONS

"JSME Mechanical engineers Handbook 4 Fluids Engineering", Fundamentals, 1st edition, Japanese Society for Mechanical Engineers, Jan. 2006.

(Continued)

*Primary Examiner* — Paul R Durand
*Assistant Examiner* — Vishal Pancholi
(74) *Attorney, Agent, or Firm* — Mattingly & Malur, PC

(57) ABSTRACT

The present invention is to suppress generation of cavitation in an impeller of a pump and disproportion of generation areas thereof by suppressing a secondary flow generated in a bent portion of a pump suction pipe. A pump suction pipe includes: a suction pipe outlet portion that is connected to an impeller suction port of a pump and is arranged in the up-and-down direction; a suction pipe inlet portion that is arranged in the lateral direction; and a suction pipe bent portion that connects the suction pipe outlet portion and the suction pipe inlet portion to each other and changes a flow from the lateral direction to the up-and-down direction. The distance from a reference point to an inner end of the suction pipe bent portion is monotonically increased from the upstream side to the downstream side on a vertical cross-section.

10 Claims, 3 Drawing Sheets

(56) References Cited

U.S. PATENT DOCUMENTS

| | | | | | |
|---|---|---|---|---|---|
| 1,022,126 | A * | 4/1912 | Dennison | 369/158 |
| 1,542,983 | A * | 6/1925 | Bergmann, Jr. | 72/58 |
| 1,712,273 | A * | 5/1929 | Kennedy | 285/323 |
| 1,837,901 | A * | 12/1931 | Fottinger et al. | 244/130 |
| 2,823,703 | A * | 2/1958 | Nusser, Jr. | 285/181 |
| 3,404,995 | A * | 10/1968 | Newman | 503/203 |
| 3,450,442 | A * | 6/1969 | Farnworth | 406/195 |
| 3,623,511 | A * | 11/1971 | Levin | 138/39 |
| 3,681,862 | A * | 8/1972 | De Koning et al. | 37/317 |
| 4,094,548 | A * | 6/1978 | Schnell | 299/9 |
| 4,387,914 | A * | 6/1983 | Paulson et al. | 285/119 |
| 4,653,777 | A * | 3/1987 | Kawatsu | 285/16 |
| 4,772,389 | A * | 9/1988 | Guibault | 210/232 |
| 5,531,484 | A * | 7/1996 | Kawano | 285/179.2 |
| 5,593,279 | A * | 1/1997 | Hayashi | 415/213.1 |
| 6,290,266 | B1 * | 9/2001 | Kawano | 285/125.1 |
| 6,799,608 | B1 * | 10/2004 | Koshika et al. | 138/177 |
| 6,890,149 | B2 * | 5/2005 | Metz et al. | 415/126 |
| 7,171,986 | B2 * | 2/2007 | Canova et al. | 138/37 |
| 2004/0084899 | A1 * | 5/2004 | Gonzales et al. | 285/179 |
| 2008/0092975 | A1 * | 4/2008 | Grimes et al. | 138/177 |

FOREIGN PATENT DOCUMENTS

| | | |
|---|---|---|
| JP | 58-33887 | 3/1983 |
| JP | 1-76597 | 5/1989 |
| JP | 11-70894 A | 3/1999 |

OTHER PUBLICATIONS

Shoichi Harada, "Nagaregaku 10shou (10 Articles of Fluid dynamics)" 1st Edition, Youkenou, Feb. 1989, p. 42.

Chinese Office Action received in corresponding Chinese Application No. 2013101241000.0 dated Apr. 1, 2015.

* cited by examiner

PUMP SUCTION PIPE

The present application claims priority from Japanese patent application 2012-090626 filed on Apr. 12, 2012, the content of which is hereby incorporated by reference into this application.

BACKGROUND OF THE INVENTION

The present invention relates to a pump suction pipe, and particularly to a pump suction pipe having a bent portion.

In a pumping station such as a drainage pumping station, water sucked from a water channel through a suction pipe is pressurized by a pump body in many cases. In this case, the suction pipe has not only a straight pipe portion but also a bent pipe portion. An example of a pump suction pipe having such a bent pipe portion is described in Japanese Unexamined Utility Model Application Publication No. H1-76597/1989 and Japanese Unexamined Utility Model Application Publication No. S58-33887/1983.

Japanese Unexamined Utility Model Application Publication No. H1-76597 describes that in order to guide regulated water to a pump while suppressing the drift of a flow flowing into a suction pipe, a suction port is opened towards the inflow direction in a vertical pump, and a regulation bent pipe bent towards the upper direction is provided at a tip end of a suction portion. In this case, the regulation bent pipe is configured like a bent pipe, and is formed in a curve line (curve surface) in accordance with the curvature of the bent pipe slightly on the inner side relative to a central axis of the bent pipe, namely, on the side where the radius of curvature is small.

Japanese Unexamined Utility Model Application Publication No. S58-33887 describes that in a suction pipe channel of a pump in which a center line of a suction port of the pump is in a horizontal direction or nearly in a horizontal direction and which suction inlet is submerged in the fluid through a suction bend pipe formed vertically or with an almost vertical angle, a divider is provided at the bent pipe to improve the flow of the fluid from the bent pipe to the pump. Further, the divider is bent on the side near the pump. The cross-sectional area of the outer flow channel is the largest on the outlet side, namely, on the side of the pump, and the cross-sectional area of the inner flow channel is the smallest on the outlet side, namely, on the side of the pump among the flow channels divided by the divider.

Further, a bend with guide vanes is disclosed as a bent pipe used for such a suction pipe in "JSME Mechanical Engineers' Handbook: Fundamentals α4: Fluid Engineering", First Edition, The Japan Society of Mechanical Engineers, January, 2006, α4-PP. 73, 77, 78. In order to decrease a loss in the bend while suppressing a secondary flow or flow separation generated in the bend, the document describes that guide vanes obtained by bending thin plates into an arc shape with a central angle of 90 degrees are concentrically inserted into the bend, and are attached to the position where partial flow channels divided by the guide vanes have the same radius ratio.

Incidentally, as described in "10 Articles of Fluid dynamics" written and edited by Masakazu, HARADA, First Edition, Yokendo co. Ltd., February, 1989, p. 42, the velocity of a flow flowing into a bent pipe is slow near a wall surface of a flow channel due to friction between the wall surface of the flow channel and a liquid (water), and is fast in the middle of the flow channel. When the flow passes through a bent portion, the centrifugal force is applied to the liquid. The centrifugal force increases in proportion to the square of the velocity in the arc-like direction (arc circumferential direction) along the bent portion, and is applied in the direction (arc radial direction) from the inner circumferential side to the outer circumferential side of the bent portion.

As a result, the mainstream of the liquid in the middle of the flow channel of the bent portion flows from the center of the flow channel of the bent portion towards the outer circumferential side by the action of the centrifugal force as described in "10 Articles of Fluid dynamics". Further, a pressure gradient in the radial direction of the arc occurs in the liquid bent like an arc by passing through the bent portion due to the centrifugal force applied in the radial direction of the arc. In this case, the pressure is high on the outer circumferential side, and low on the inner circumferential side.

On the other hand, in the flow passing through the bent portion, a boundary layer is formed near the wall surface where the velocity in the circumferential direction of the arc is slower than that of the mainstream in the middle of the flow channel. The flow in the boundary layer cannot match, in the circumferential direction of the arc, the mainstream in the middle of the flow channel that becomes a flow flowing from the center of the flow channel to the outer side due to the action of the centrifugal force, and forms a flow flowing from the outer circumferential side where the pressure is high to the inner side where the pressure is low along the wall surface. In addition, in the cross-section orthogonal to the central axis of the bent portion, a secondary flow flowing from the center of the flow channel to the outer side is formed in the middle of the flow channel, and the secondary flow flowing from the outer side to the inner side along the wall surface is formed near the wall surface.

The secondary flow is similarly generated in a pump suction pipe having a bent portion. Further, if a liquid flows into an impeller suction port after passing through the bent portion while the secondary flow remains in the pump suction pipe, an area of a discrepancy between the inflow angle of a liquid at the impeller suction port and the blade angle of the impeller is generated at the impeller suction port in the circumferential direction relative to the rotational axis of the impeller even at the design point in some cases.

In the area where a discrepancy between the inflow angle of a liquid at the impeller suction port and the blade angle of the impeller is large, the liquid near a leading edge of the impeller blade does not flow in along the blade, but flows around a tip end of the blade. In the area where the liquid flows around a tip end of the blade, the relative velocity of the liquid to the impeller is locally increased, and the pressure is decreased. As a result, under the pump operation conditions where the pressure of the inlet of the impeller is low, cavitation is likely to be locally generated in the area where the liquid near a leading edge of the impeller blade flows around a tip end of the blade.

Further, due to an influence of the secondary flow generated at the bent portion to reach the impeller suction port, the areas where a difference between the inflow angle of a liquid at the impeller suction port and the blade angle of the impeller is large are disproportionately generated in the circumferential direction relative to the rotational axis of the impeller, and areas of the cavitation that is locally generated as described above are disproportionately generated as similar to the above. As a result of generation of the cavitation in the disproportionate areas, fluctuating force is loaded on the impeller due to a density difference between a gas area of cavitation with low density and a normal fluid area, and large oscillation and noise are likely to be generated in the pump.

In the conventional suction pipe of the pump described in Japanese Unexamined Utility Model Application Publication No. H1-76597 or Japanese Unexamined Utility Model Application Publication No. S58-33887, or the bend described in "JSME Mechanical Engineers' Handbook", the secondary flow flowing from the inner side to the outer side is suppressed in the middle of the flow channel of the bent portion by employing the bent pipe with a divider and the regulation bent pipe. However, if the divider is additionally provided, designing, processing, and construction become complicated, leading to an increase in cost. Further, in an operation at the non-design point (an area of a low flow rate), it is generally well known that a recirculation flowing from the impeller to the suction side is generated on the shroud side of the impeller. If the recirculation area becomes large, the recirculation area reaches as far as a divider or a regulation plate. In this case, the recirculation hits the divider or the regulation plate to generate oscillation or noise that possibly damages the divider or the regulation plate.

BRIEF SUMMARY OF THE INVENTION

The present invention has been made in view of the problems of the conventional technique, and an object thereof is to suppress generation of cavitation generated in an impeller of a pump and disproportion of generation areas thereof by suppressing a secondary flow generated in a bent portion of a pump suction pipe. In addition, an impact of a recirculation from the impeller is reduced by forming the bent portion of the suction pipe in a simple shape.

In the following description, a "vertical cross-section" is a cross-section at a plane including a rotational axis of a pump and a central axis of a suction pipe. Further, a "horizontal cross-section" is a cross-section at a plane orthogonal to the central axis of the suction pipe or the rotational axis of the pump. In addition, a "reference point" is a point on a vertical cross-section and on the line of intersection between a plane where a suction pipe outlet portion and a suction pipe bent portion are connected to each other and a plane where a suction pipe inlet portion and the suction pipe bent portion are connected to each other in the suction pipe of the pump including a bent pipe portion (suction pipe bent portion). Further, an "elbow" generally means a pipe with a smaller curvature radius as compared to the bend as described in α4-pp. 77 and 78 of "JSME Mechanical Engineers' Handbook". However, the elbow means one produced using plural members without using a bending process machine such a bender at the time of processing the bent direction of a flow in the present invention.

According to the characteristics of the present invention that achieves the above-described object, provided is a pump suction pipe including: a suction pipe outlet portion that is connected to an impeller suction port of a pump and is arranged in the up-and-down direction; a suction pipe inlet portion that is arranged in the lateral direction; and a suction pipe bent portion that connects the suction pipe outlet portion and the suction pipe inlet portion to each other and changes a flow from the lateral direction to the up-and-down direction, wherein if a point on a vertical cross-section and on the line of intersection between a connection plane where the suction pipe bent portion is connected to the suction pipe outlet portion and a connection plane where the suction pipe bent portion is connected to the suction pipe inlet portion is set as a reference point, the distance from the reference point to an inner end of the suction pipe bent portion is monotonically increased from the upstream side to the downstream side on a vertical cross-section.

In the characteristics, the distance from the reference point to an outer end of the suction pipe bent portion is desirably monotonically decreased from the upstream side to the downstream side on a vertical cross-section, and a horizontal cross-section of the suction pipe bent portion is desirably formed substantially in a circular shape. Further, the suction pipe bent portion may be formed in such a manner that flat plates are bent to form plural cylindrical members that are jointed together to be in an elbow shape, and the suction pipe outlet portion may be formed in a reduction pipe shape in which the inner diameter of an end connected to the suction pipe bent portion is large and the inner diameter of an end connected to the impeller suction port is small. Furthermore, an inclined angle (α) of the suction pipe outlet portion may be equal to or larger than a tangent angle (β) at an end connected between the suction pipe bent portion and the suction pipe outlet portion, the tangent angle (β) being a tangent angle at an inner end of the suction pipe bent portion on a vertical cross-section.

According to the present invention, the distance from the reference point to the inner side of the suction pipe bent portion of the pump is monotonically increased from the upstream side to the downstream side. Thus, a pressure gradient caused by the centrifugal force at the suction pipe bent portion can be decreased from the upstream side to the downstream side. Accordingly, a secondary flow in the suction pipe bent portion can be suppressed, and thus generation of cavitation generated in an impeller of a pump and disproportion of generation areas thereof can be suppressed. Further, it is not necessary to provide a guide vane in the suction pipe bent portion. Thus, the shape of the suction pipe bent portion can be simplified, and an influence of a recirculation from the impeller can be reduced.

DETAILED DESCRIPTION OF THE INVENTION

Figure 1:
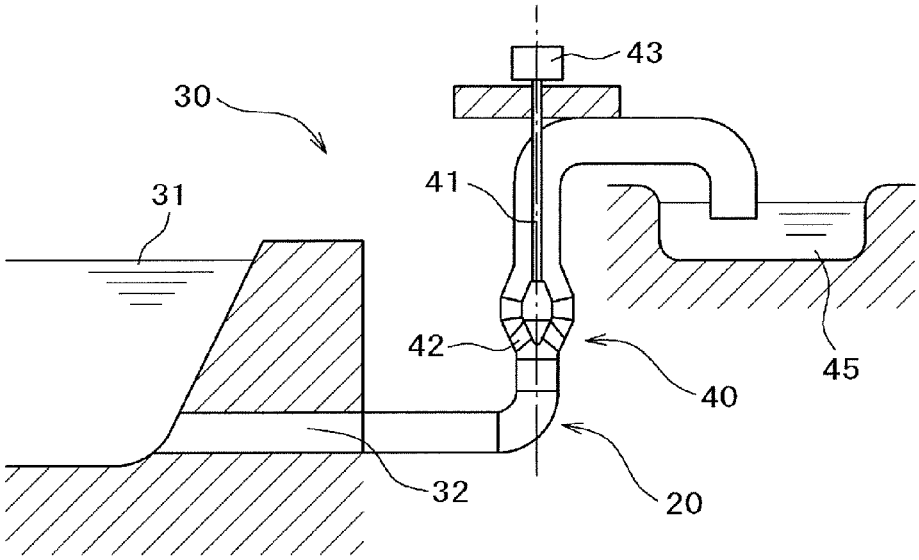
FIG. 1 is a partial vertical cross-sectional view of a pump unit according to the present invention.

Hereinafter, several embodiments of a pump suction pipe according to the present invention will be described using the drawings. FIG. 1 is a cross-sectional view of a part of a pump unit arranged in a pumping station. FIG. 2 to FIG. 5 are vertical cross-sectional views of the respective embodiments of a pump suction pipe 20 according to the present invention. It should be noted that in a flow channel in a suction pipe bent portion 1 shown in each vertical cross-sectional view, the side near a reference point is referred to as the inner side and the side far from the reference point is referred to as the outer side in the description of the present invention. Thus, the inner and outer sides are not meant to indicate the inside and outside of the pipe.

In a pump unit 30, a pump 40 arranged in a vertical axis sucks water from the pump suction pipe 20 connected to a headrace 32 directly from a river 31 or through the headrace 32 from the river 31, and feeds the same to a water reservoir or drainage facility 45. An impeller 42 is provided at a lower end of the pump 40, and is driven to rotate by a rotational axis 41 connected to a driving machine 43 such as a motor.

[First Embodiment]

Figure 2:
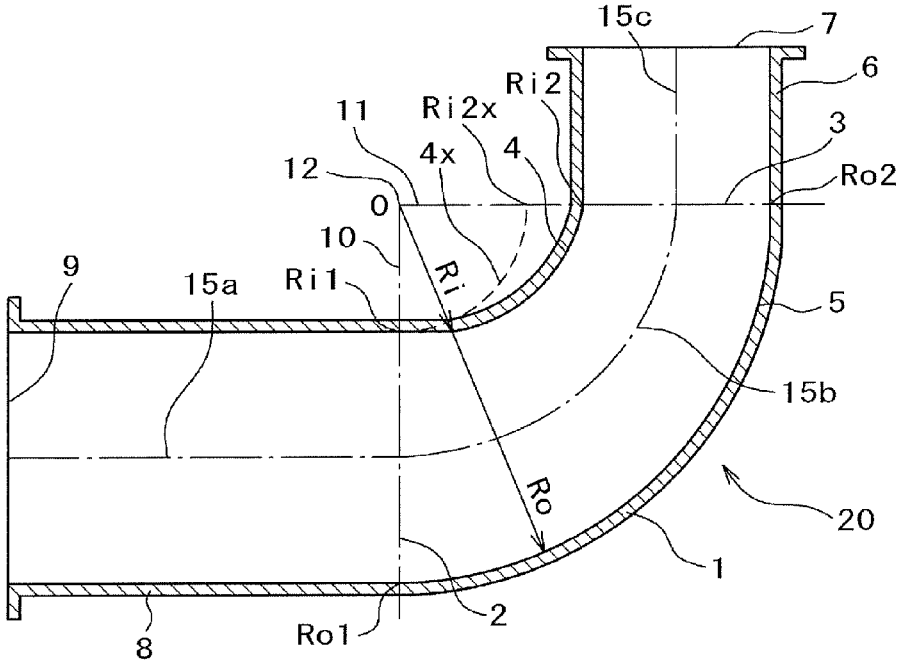
FIG. 2 is a vertical cross-sectional view of an embodiment of a pump suction pipe included in the pump unit shown in FIG. 1.

An embodiment of a suction pipe 20 included in the pump unit 30 configured as described above is shown using a vertical cross-sectional view of FIG. 2. The suction pipe 20 of the pump of the embodiment is used to change the direction of water flowing in the horizontal direction to the vertical direction. Therefore, the suction pipe 20 of the pump includes a suction pipe inlet portion 8 arranged in the lateral direction that is nearly the horizontal direction, a suction pipe outlet portion 6 arranged in the up-and-down direction that is nearly the vertical direction, and a suction pipe bent portion 1 that connects the suction pipe inlet portion 8 and the suction pipe outlet portion 6 to each other. The suction pipe inlet portion 8 and the suction pipe outlet portion 6 are straight pipes each having a circular cross-section. Accordingly, a central axis 15*a* of the suction pipe inlet portion 8 is nearly in the horizontal direction, and a central axis 15*c* of the suction pipe outlet portion 6 is nearly in the vertical direction.

The suction pipe bent portion 1 characterized in the present invention that connects the suction pipe inlet portion 8 and the suction pipe outlet portion 6 to each other is configured as follows. A suction pipe bent portion inlet 2 that is an outlet-side end portion of the suction pipe inlet portion 8 has a vertical plane orthogonal to the central axis 15*a* of the suction pipe inlet portion 8. The vertical plane is referred to as an inlet-side reference plane 10. Further, a suction pipe bent portion outlet 3 that is an inlet-side end portion of the suction pipe outlet portion 6 has a horizontal plane orthogonal to the central axis 15*c* of the suction pipe outlet portion 6. The horizontal plane is referred to as an outlet-side reference plane 11.

The inlet-side reference plane 10 and the outlet-side reference plane 11 intersect with each other at the line of intersection. The line of intersection is referred to as a reference line 12. On the other hand, a point where a plane (vertical cross-section) PL including the both center lines 15*a* and 15*c* of the suction pipe inlet portion 8 and the suction pipe outlet portion 6 formed like straight pipes intersects with the reference line 12 forms a reference point (original point O) of the suction pipe bent portion 1. The plane PL includes a center line of the rotational axis 41 of the pump 40.

An inner circular curve 4*x* having a radius of the distance from the reference point as the center point to an upper end point $Ri_1$ of the outlet-side end portion of the suction pipe inlet portion 8 is shown using a dotted line on the plane PL. Likewise, a circular curve (outer-end curve 5) having a radius of the distance from the reference point as the center point to a lower end point $Ro_1$ of the outlet-side end portion of the suction pipe inlet portion 8 is shown using a solid line.

A point $Ro_2$ where the outer-end curve 5 intersects with the outlet-side reference plane 11 is located at a right end of the suction pipe bent portion outlet 3. On the other hand, a point $Ri_2$ that is located at a left end of the suction pipe bent portion outlet 3 is located on the right side relative to a point $Ri_{2x}$ where the inner circular curve 4*x* intersects with the outlet-side reference plane 11 in FIG. 2. Specifically, the distance from the reference point O to the point $Ri_2$ is longer than that from the reference point O to the point $Ri_{2x}$.

An inner-end curve 4 of the suction pipe bent portion 1 on the plane PL is a smooth curve connecting the point $Ri_1$ to the point $Ri_2$, and a distance Ri from the reference point O is monotonically increased from the suction pipe bent portion inlet 2 to the suction pipe bent portion outlet 3. Specifically, as an angle (winding angle) formed by a line connecting a point on the inner-end curve 4 to the reference point O and the inlet-side reference plane 10 becomes large, the distance Ri from the reference point O to a point on the inner-end curve 4 is monotonically increased. When an intermediate point between a point on the inner-end curve 4 and a point on the outer-end curve 5 from the reference point O at the same subtended angle on the plane PL is connected to another, a center line 15*b* of the suction pipe bent portion 1 can be obtained.

A behavior of water flowing in the suction pipe 20 of the pump of the embodiment configured as described above will be described below. The centrifugal force acting in the direction from the inner side to the outer side of the suction pipe bent portion 1 is applied to water flowing through the suction pipe bent portion 1 at which the water being changed the flow direction from the horizontal direction to the vertical direction, in accordance with the distance from the reference point O. As a result, a pressure gradient occurs from the inner side to the outer side of the suction pipe bent portion 1. In addition, the pressure of the water is high on the outer side and low on the inner side.

Specifically, on a plane PLb orthogonal to the center line 15*b* of the suction pipe bent portion 1, a local pressure gradient represented by a formula of $\rho V^2/r$ occurs in the direction from the inner side to the outer side. In the formula, the pressure of water is represented by p, the density is represented by ρ, the distance from the reference point O is represented by r, and the vertical velocity component of the water relative to the plane PLb at a point having distance r is represented by V.

If the distance Ri from the reference point O to the inner-end curve 4 of the suction pipe bent portion 1 is monotonically increased, the distance from the reference point O to the center line 15*b* of the suction pipe bent portion 1 becomes longer than the distance from the reference point O to the center line of the conventional bent pipe shown by the inner circular curve 4*x* from the suction pipe bent portion inlet 2 to the suction pipe bent portion outlet 3. Accordingly, the denominator (the distance from the reference point O is r) of the formula of the pressure gradient becomes large, and the pressure gradient is decreased as compared to the conventional bent pipe.

Since the pressure gradient in the direction from the inner side to the outer side in the suction pipe bent portion 1 is decreased, a pressure difference between the inner side and outer side of the suction pipe bent portion 1 is decreased, a flow flowing from the outer side to the inner side along a wall surface generated by the pressure difference between the inner side and the outer side is suppressed in a boundary layer formed near the wall surface of the suction pipe bent portion 1, and a secondary flow in the suction pipe bent portion 1 is suppressed.

As a result, according to the embodiment, the secondary flow that is likely to be generated in the suction pipe bent portion 1 can be suppressed without providing flow guiding means such as a divider in the inner flow channel of the suction pipe bent portion 1. Accordingly, the secondary flow reaching an impeller suction port can be decreased, and it is possible to suppress generation of cavitation and ununiform distribution of generation areas thereof caused by ununiformity, in the circumferential direction relative to the rotational axis of the impeller, of a discrepancy between the inflow angle of water at the impeller suction port and the blade angle of the impeller.

[Second Embodiment]

Figure 3:
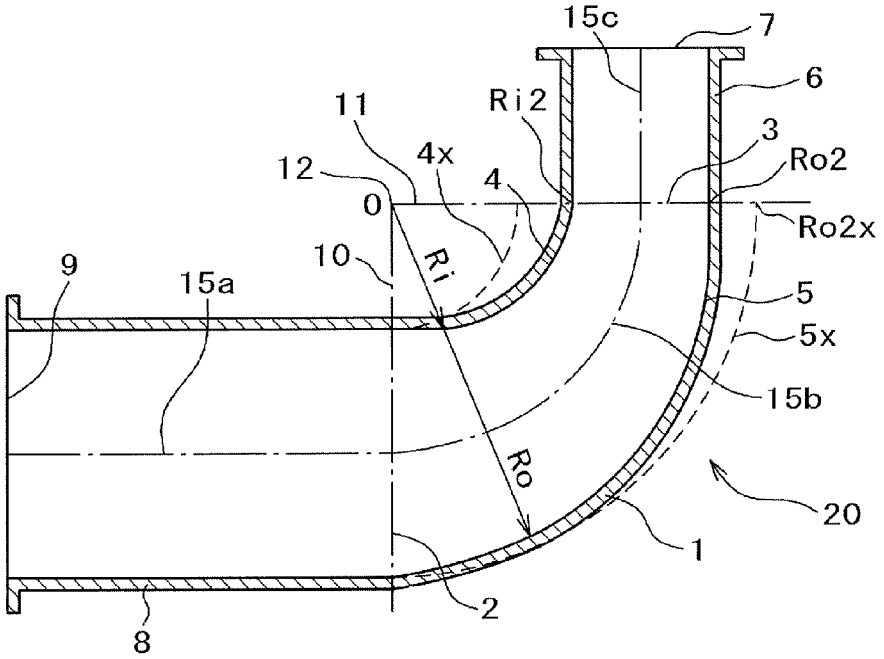
FIG. 3 to FIG. 5 are vertical cross-sectional views of other embodiments of a pump suction pipe according to the present invention.

FIG. 3 shows a vertical cross-sectional view of another embodiment of the suction pipe 20 of the pump according to the present invention. The embodiment is different from the first embodiment shown in FIG. 2 in that in addition to the distance Ri from the reference point O on the inner side of the suction pipe bent portion 1 of the suction pipe 20 of the pump, a distance Ro from the reference point O on the outer side is also changed from the suction pipe bent portion inlet 2 to the suction pipe bent portion outlet 3. It should be noted that the shape of the inner-end curve 4 of the suction pipe bent portion 1 is the same as that of the first embodiment shown in FIG. 2.

Specifically, the outer-end curve 5 of the suction pipe bent portion 1 is shaped in such a manner that the distance from the reference point O to the outer-end curve 5 is monotonically decreased from the suction pipe bent portion inlet 2 to the suction pipe bent portion outlet 3 as compared to the shape of a conventional outer circular curve 5*x* with the distance Ro from the reference point O being constant. Accordingly, an intersection point $Ro_2$ between the outlet-side reference plane 11 and the outer-end curve 5 is located on the left side relative to an intersection point $Ro_{2x}$ between the outlet-side reference plane 11 and the outer circular curve 5*x* in FIG. 3. It should be noted that the cross-sectional area of the plane PLb orthogonal to the center line 15*b* of the suction pipe bent portion 1 is in a contraction flow state in which the flow rate is monotonically decreased.

As a result, it is possible to suppress the development of the boundary layer near the wall surface from the side of the suction pipe bent portion inlet 2 to the side of the suction pipe bent portion outlet 3 of the suction pipe bent portion 1 caused by accelerating the flow rate of water flowing in the suction pipe bent portion 1. Accordingly, the boundary layer near the wall surface developed in the suction pipe bent portion 1 that is a cause of the secondary flow can be suppressed, and thus the secondary flow flowing from the outer side to the inner side along the wall surface caused by the pressure difference between the inner side and the outer side can be further decreased.

Even in the embodiment, the secondary flow that is likely to be generated in the suction pipe bent portion 1 can be suppressed without providing flow guiding means such as a divider in the inner flow channel of the suction pipe bent portion 1. Further, the secondary flow reaching an impeller suction port can be decreased, and it is possible to suppress generation of cavitation and ununiform distribution of generation areas thereof caused by ununiformity, in the circumferential direction relative to the rotational axis of the impeller, of a discrepancy between the inflow angle of water at the impeller suction port and the blade angle of the impeller.

[Third Embodiment]

Figure 4:
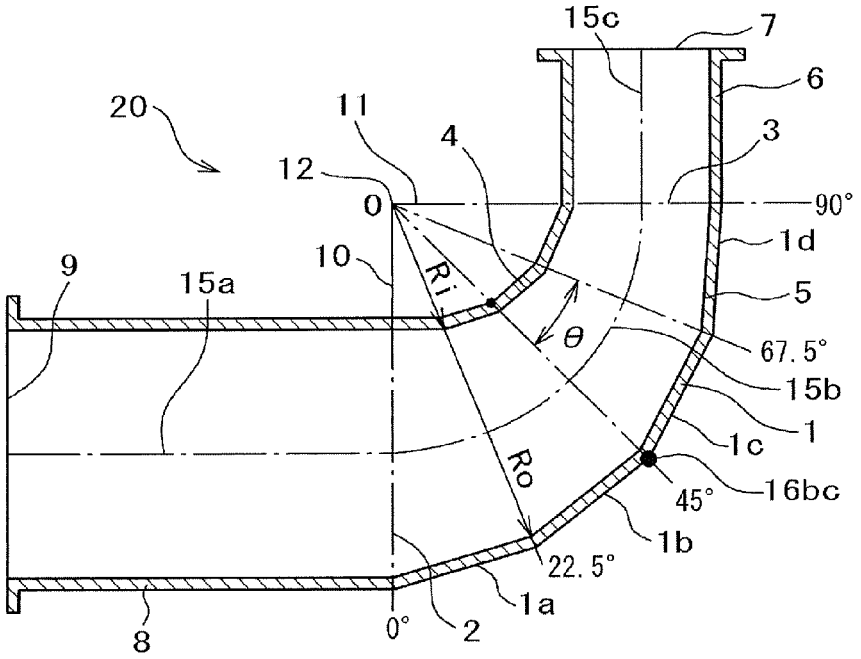

FIG. 4 shows a vertical cross-sectional view of still another embodiment of the suction pipe 20 of the pump according to the present invention. The embodiment is different from the first and second embodiments in that the suction pipe 20 of the pump is produced by casting or machining such as lathe turning in the first and second embodiments, whereas the suction pipe 20 of the pump is produced by combining a welding and press-manufacturing process in the third embodiment. The shape of the suction pipe 20 of the embodiment is similar to that of the second embodiment shown in FIG. 3. The suction pipe bent portion 1 shown in FIG. 3 is divided by plural planes orthogonal to the center line 15*b*, and the divided parts are formed to be similar to a press product. Thereafter, the divided parts are connected to each other by welding.

The embodiment will be concretely described using the shape shown in FIG. 4. The suction pipe inlet portion 8 and the suction pipe outlet portion 6 are produced as similar to the first and second embodiments. The flow direction is changed by the suction pipe bent portion 1 by 90°, and thus a central angle 8 is divided into four by 22.5°. Materials expanded into flat plates to be the divided parts are bent to produce bent pipe members 1*a* to 1*d*, and end faces thereof are connected to each other by butt welding. FIG. 4 shows a state in which the bent pipe members 1*b* and 1*c* are welded to each other at a butt welding portion 16*bc*. However, other bent pipe members 1*a* to 1*d*; the bent pipe member 1*a* and the suction pipe inlet portion 8; and the bent pipe member 1*d* and the suction pipe outlet portion 6 can be similarly welded to each other by butt welding. As a result of the welding process, the suction pipe bent portion 1 is formed in an elbow shape. It should be noted that both ends of the inlet and outlet of the flow channel formed using the bent pipe members 1*a* to 1*d* formed by bending flat plates are in a circular shape.

According to the embodiment, the suction pipe 20 of the pump can be easily manufactured, and the processing cost can be saved. Further, the cost can be reduced and the delivery date can be advanced. It should be noted that the suction pipe of the second embodiment is formed by using pressing and welding in the third embodiment. However, the suction pipe shown in the first embodiment or a fourth embodiment to be described below can be similarly formed by using pressing and welding. Further, the suction pipe bent portion 1 of FIG. 4 is divided into four, but may be other than four.

[Fourth Embodiment]

Figure 5:
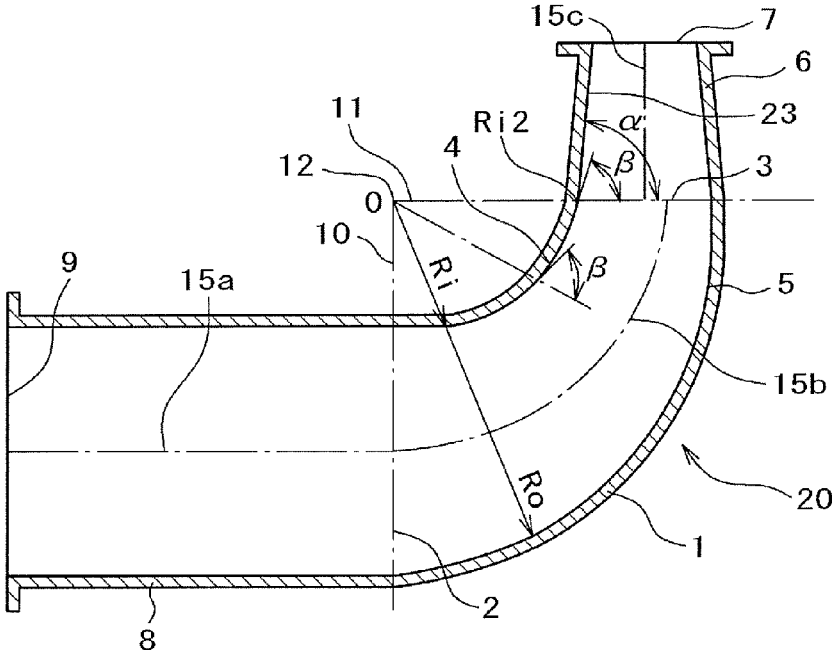

FIG. 5 shows a vertical cross-sectional view of still another embodiment of the suction pipe 20 of the pump according to the present invention. The embodiment is different from the first to third embodiments in that the shape of the suction pipe outlet portion 6 is changed without changing the shape of the suction pipe bent portion 1. The suction pipe inlet portion 8 and the suction pipe bent portion 1 shown in any one of the first to third embodiments can be applied.

An angle formed by the tangent of the inner-end curve 4 at an arbitrary point P on the inner-end curve 4 of the suction pipe bent portion 1 and a line passing through the reference point O and the point P is referred to as a tangent angle β. The suction pipe outlet portion 6 is formed as a reduction pipe and the inclined angle thereof is represented by α. The inclined angle α corresponds to an angle formed by a straight line 23 of an inner end of the suction pipe outlet portion 6 and the outlet-side reference plane 11 on the plane PL. It should be noted that the center line 15*c* of the suction pipe outlet portion 6 is in the vertical direction as similar to the first to third embodiments. The suction pipe outlet portion 6 is a reduction pipe in which the area of a horizontal cross-section is reduced from the suction pipe bent portion outlet (a lower end of the suction pipe outlet portion) 3 to an upper end 7 of the suction pipe outlet portion 6.

According to the embodiment, the suction pipe outlet portion 6 is formed as a reduction pipe, and thus an angle difference (α−β) between the tangent angle β at a point $Ri_2$ of an outlet end of the inner-end curve 4 of the suction pipe bent portion 1 and the inclined angle α of the suction pipe outlet portion 6 becomes small at the connection position between the suction pipe outlet portion 6 and the suction pipe bent portion 1. In addition, the flow direction on the side of the suction pipe bent portion outlet 3 matches that on the lower end side of the suction pipe outlet portion 6, so that the turbulence of a flow that is likely to occur in the suction pipe outlet portion 6 can be reduced, and an attenuation effect of the secondary flow in the suction pipe outlet portion 6 can be enhanced. As a result, it is possible to suppress generation of cavitation and ununiform distribution of generation areas thereof caused by ununiformity, in the circumferential direction relative to the rotational axis of the impeller, of a discrepancy between the inflow angle of water at the impeller suction port and the blade angle of the impeller.

It should be noted that the inclined angle α of the suction pipe outlet portion 6 is desirably larger than the tangent angle β at the point $Ri_2$ of the outlet end of the inner-end curve 4 of the suction pipe bent portion 1, and is desirably a value not exceeding 90°. Specifically, although the suction pipe outlet portion 6 is formed as a reduction pipe, excessive contraction should be avoided.

Figure 6:
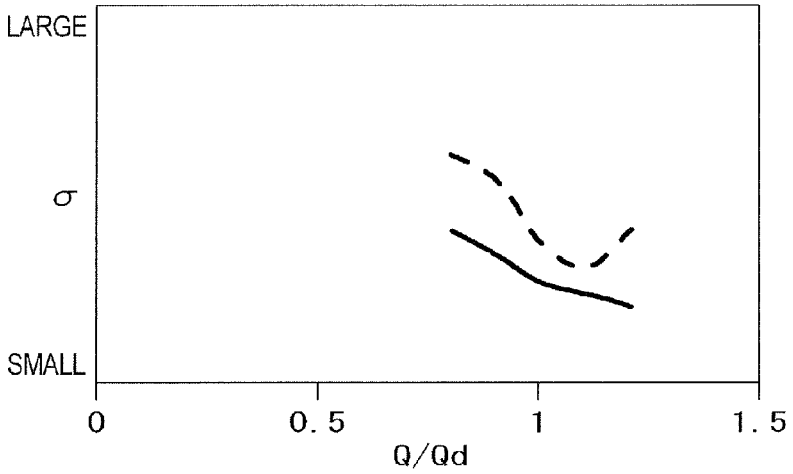
FIG. 6 is a graph for explaining characteristics of cavitation of the pump suction pipe according to the present invention.

An experimental result of the cavitation performance of the pump when the suction pipe 20 of the fourth embodiment was used is shown in FIG. 6 while being compared to a case in which a conventional suction pipe was used. The case in which the conventional suction pipe was used is shown by a dotted line, and the case in which the suction pipe 20 according to the present invention was used is shown by a solid line. In this case, the cavitation performance is determined based on NPSH (Net Positive Suction Head) in which cavitation is generated.

The horizontal axis represents a flow rate Q/Qd normalized with a flow rate at the design point, and the vertical axis represents a dimensionless cavitation coefficient σ obtained by converting NPSH in which cavitation is generated using the total pump head at the design point of the pump. In the case where the suction pipe 20 according to the present invention is used, it can be found that the cavitation coefficient σ becomes smaller than the case in which the conventional suction pipe 20 is used, and NPSH in which cavitation is generated becomes lower. Since NPSH in which cavitation is generated is low, the cavitation is hardly generated even under the operation conditions of the pump in which the pressure of the inlet of the impeller is low (NPSH is low).

In the first to fourth embodiments, a cross-section (horizontal cross-section) orthogonal to the central axis of each of the suction pipe inlet portion 8 and the suction pipe outlet portion 6 is formed substantially in a circular shape. However, the present invention can be applied to not only such a circular pipe, but also a shape slightly swelled in the lateral direction such as an oval shape. Even in such a case, the distance Ri from the reference point O to the inner-end curve 4 of the suction pipe bent portion 1 needs to be monotonically increased in the shape of a cross-section of a plane including the central axis.

Further, in the first to fourth embodiments, the distances Ri and Ro from the reference point, the central angle θ, the inclined angle α, the tangent angle β, and the like are based on the inner side of the suction pipe bent portion 1, but may be based on the outer side as long as the thickness of the pipe is the same.

What is claimed is:

1. A pump suction pipe comprising:

a suction pipe outlet portion having an outlet that is connected to an impeller suction port of a pump, and which has a central axis which is substantially vertical;

a suction pipe inlet portion having an inlet that is connected to a headrace, and which has a central axis which is substantially horizontal, wherein a diameter of the inlet is larger than a diameter of the outlet; and a suction pipe bent portion that connects the suction pipe outlet portion and the suction pipe inlet portion to each other and changes a flow of fluid through the suction pipe inlet portion to the suction pipe outlet portion from a horizontal direction to a vertical direction, wherein the pump causes the fluid to flow in from the headrace to the suction pipe inlet portion horizontally, flow through the suction pipe bent portion, and flow out from the suction pipe outlet portion vertically towards the impeller suction port, wherein the suction pipe bent portion includes a suction pipe bent portion outlet that defines an outlet-side reference plane orthogonal to the central axis of the suction pipe outlet portion where the suction pipe bent portion outlet connects to the suction pipe outlet portion, wherein the suction pipe bent portion includes a suction pipe bent portion inlet that defines an inlet-side reference plane orthogonal to the central axis of the suction pipe inlet portion plane where the suction pipe inlet portion connects to the suction pipe bent portion inlet, and wherein an intersection of a vertical cross-sectional plane of the pump suction pipe, the outlet-side reference plane, and the inlet-side reference plane is set as a reference point, and a distance from the reference point to an inner end of the suction pipe bent portion in the vertical cross-sectional plane monotonically increases from the inlet-side reference plane to the outlet-side reference plane.

2. The pump suction pipe according to claim 1, wherein a distance from the reference point to an outer end of the suction pipe bent portion monotonically decreases from the inlet-side reference plane to the outlet-side reference plane in the vertical cross-sectional plane.

3. The pump suction pipe according to claim 1, wherein the suction pipe outlet portion has a reduction pipe shape in which an inner diameter of an end connected to the suction pipe bent portion is larger than an inner diameter of an end connected to the impeller suction port.

4. The pump suction pipe according to claim 3, wherein an inclined angle (α) of the suction pipe outlet portion is equal to or larger than a tangent angle (β) at an end connected between the suction pipe bent portion and the suction pipe outlet portion, the tangent angle (β) being a tangent angle at the inner end of the suction pipe bent portion in the vertical cross-sectional plane.

5. A pump suction pipe comprising:

a suction pipe outlet portion that is connected to an impeller suction port of a pump, and which has a central axis which is substantially vertical;

a suction pipe inlet portion that is connected to a headrace, and which has a central axis which is substantially horizontal;

a suction pipe bent portion that connects the suction pipe outlet portion and the suction pipe inlet portion to each other and changes a flow of fluid therein from a horizontal direction to a vertical direction, the suction pipe bent portion having an inner end that defines an inner end curve occupying a portion of the inner end of the suction pipe bent portion, wherein the pump causes the fluid to flow in the suction pipe inlet portion horizontally, flow through the suction pipe bent portion, and flow out from the suction pipe outlet portion vertically towards the impeller suction port, wherein the suction pipe bent portion includes a suction pipe bent portion outlet that defines an outlet-side reference plane orthogonal to the central axis of the suction pipe outlet portion where the suction pipe bent portion outlet connects to the suction pipe outlet portion, wherein the suction pipe bent portion includes a suction pipe bent portion inlet that defines an inlet-side reference plane orthogonal to the central axis of the suction pipe inlet portion plane where the suction pipe inlet portion connects to the suction pipe bent portion inlet, wherein a vertical cross-sectional plane includes the central axis of the suction pipe inlet portion and the central axis of the suction pipe outlet portion, wherein an intersection of the vertical cross-sectional plane, the outlet-side reference plane, and the inlet-side reference plane is set as a reference point, and a distance from the reference point to the inner end of the suction pipe bent portion in the vertical cross-sectional plane monotonically increases from the inlet-side reference plane to the outlet-side reference plane, and wherein a radius of curvature of the inner end curve monotonically increases in the vertical cross-sectional plane towards the outlet-side reference plane.

6. The pump suction pipe according to claim 1, wherein the suction pipe bent portion further has an outer end that defines an outer end curve along a portion of an inner surface of the suction pipe bent portion further from the reference point than the inner end curve, wherein a radius of curvature of the outer end curve decreases in the vertical cross-sectional plane towards the outlet-side reference plane.

7. The pump suction pipe according to claim 5, wherein the suction pipe outlet portion has a reduction pipe shape in which an inner diameter of an end connected to the suction pipe bent portion is larger than an inner diameter of an end connected to the impeller suction port.

8. The pump suction pipe according to claim 7, wherein an inclined angle ($\alpha$) of the suction pipe outlet portion is equal to or larger than a tangent angle ($\beta$) at an end connected between the suction pipe bent portion and the suction pipe outlet portion, the tangent angle ($\beta$) being a tangent angle at the inner end of the suction pipe bent portion in the vertical cross-sectional plane.

9. A pump unit comprising:

a pump suction pipe; and a pump disposed substantially vertically and having an impeller to suck fluid through the pump suction pipe from a headrace, wherein the pump suction pipe includes:

a suction pipe outlet portion that is connected to an impeller suction port of the pump, and which has a central axis which is substantially vertical, a suction pipe inlet portion having an inlet that is connected to the headrace, and which has a central axis which is substantially horizontal, wherein a diameter of the inlet is larger than a diameter of the outlet, and a suction pipe bent portion that connects the suction pipe outlet portion and the suction pipe inlet portion to each other and changes a flow of the fluid through the suction pipe inlet portion to the suction pipe outlet portion from a horizontal direction to a vertical direction, wherein the pump causes the fluid to flow in from the suction pipe inlet portion horizontally, flow through the suction pipe bent portion, and flow out from the suction pipe outlet portion vertically towards the impeller suction port, wherein the suction pipe bent portion includes a suction pipe bent portion outlet that defines an outlet-side reference plane orthogonal to the central axis of the suction pipe outlet portion where the suction pipe bent portion outlet connects to the suction pipe outlet portion, wherein the suction pipe bent portion includes a suction pipe bent portion inlet that defines an inlet-side reference plane orthogonal to the central axis of the suction pipe inlet portion plane where the suction pipe inlet portion connects to the suction pipe bent portion inlet, and wherein an intersection of a vertical cross-sectional plane of the pump suction pipe, the outlet-side reference plane, and the inlet-side reference plane is set as a reference point, and a distance from the reference point to an inner end of the suction pipe bent portion in the vertical cross-sectional plane monotonically increases from the inlet-side reference plane to the outlet-side reference plane.

10. A pump unit comprising:

a pump suction pipe; and a pump disposed substantially vertically and having an impeller to suck fluid through the pump suction pipe from a headrace, wherein the pump suction pipe includes:

a suction pipe outlet portion that is connected to an impeller suction port of the pump, and which has a central axis which is substantially vertical, a suction pipe inlet portion that is connected to the headrace, and which has a central axis which is substantially horizontal, and a suction pipe bent portion that connects the suction pipe outlet portion and the suction pipe inlet portion to each other and changes a flow of fluid therein from a horizontal direction to a vertical direction, the suction pipe bent portion having an inner end that defines an inner end curve occupying a portion of the inner end of the suction pipe bent portion, wherein the pump causes the fluid to flow from the headrace into the suction pipe inlet portion horizontally, flow through the suction pipe bent portion, and flow out from the suction pipe outlet portion vertically towards the impeller suction port, wherein the suction pipe bent portion includes a suction pipe bent portion outlet that defines an outlet-side reference plane orthogonal to the central axis of the suction pipe outlet portion where the suction pipe bent portion outlet connects to the suction pipe outlet portion, wherein the suction pipe bent portion includes a suction pipe bent portion inlet that defines an inlet-side reference plane orthogonal to the central axis of the suction pipe inlet portion plane where the suction pipe inlet portion connects to the suction pipe bent portion inlet, wherein a vertical cross-sectional plane includes the central axis of the suction pipe inlet portion and the central axis of the suction pipe outlet portion, wherein an intersection of the vertical cross-sectional plane, the outlet-side reference plane, and the inlet-side reference plane is set as a reference point, and a distance from the reference point to the inner end of the suction pipe bent portion in the vertical cross-sectional plane monotonically increases from the inlet-side reference plane to the outlet-side reference plane, and wherein a radius of curvature of the inner end curve monotonically increases in the vertical cross-sectional plane towards the outlet-side reference plane.

* * * * *